United States Patent [19]

Jacobson

[11] 4,211,011

[45] Jul. 8, 1980

[54] SELF MEASURING GARMENT ASSEMBLY

[76] Inventor: Ilamae W. Jacobson, 316 A Trenton La., Minneapolis, Minn. 55441

[21] Appl. No.: 684,102

[22] Filed: May 7, 1976

[51] Int. Cl.[2] ..... A41H 1/02

[52] U.S. Cl. ..... 33/15; 33/137 R

[58] Field of Search ..... 33/15, 13, 14, 11, 16, 33/2 R, 137 R

[56] References Cited

U.S. PATENT DOCUMENTS 2,374,654 5/1945 Cooke ..... 33/15

FOREIGN PATENT DOCUMENTS 304463 3/1918 Fed. Rep. of Germany ..... 33/15

*Primary Examiner*—Willis Little

*Attorney, Agent, or Firm*—John W. Adams

[57] ABSTRACT

A self measuring garment assembly which includes a garment having at least one measuring tape connected to the inside thereof at the selected circumferential portion to be measured with the tape being calibrated to indicate the circumferential measurement whenever the garment is put on to thereby serve as a constant reminder to the wearer of the indicated measurement or measurements.

6 Claims, 4 Drawing Figures

SELF MEASURING GARMENT ASSEMBLY

Prior Art

Prior art devices have been invented which provide for adjustment of trousers, neckties and also a bust measuring device disclosed in U.S. Pat. No. 2,946,125. The adjustable trousers and neckties are similar to any conventional belt except for the calibration thereon; however, the calibrations are merely to provide for pre-adjustment of the size rather than to provide an accurate measurement thereof whenever the garment is worn. The bust measuring device is not, in any way, a part of a garment to be worn and is nothing more than an assembly of individual tapes for providing various bust measurements for proper brassiere fitting and design.

Statement of Purpose

The present invention provides a combination garment and measuring device whereby the wearer can quickly and accurately measure the circumference of the bust line, waist and/or hips, or other body measurements whenever the garment is put on. It is contemplated that the measuring tapes would be incorporated in a garment which is worn frequently so that the measurements will serve as an indication of progress on a diet program or as a positive indication that a person is changing weight.

The following description of the embodiment of the invention disclosed herein is made in connection with the accompanying drawings wherein like reference characters refer to similar parts, and in which:

FIG. 4 shows the garment illustrated in FIG. 3 as it would appear laid out flat before being put on.

Figure 1:
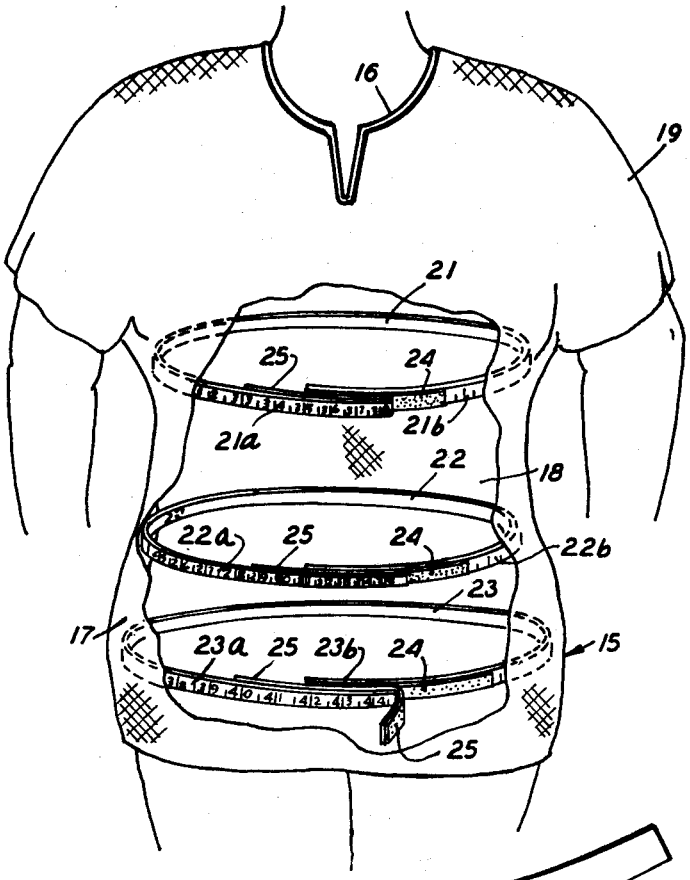
FIG. 1 is a front elevational view of a person wearing a garment which embodies one form of the invention and showing portions broken away.
Figure 2:
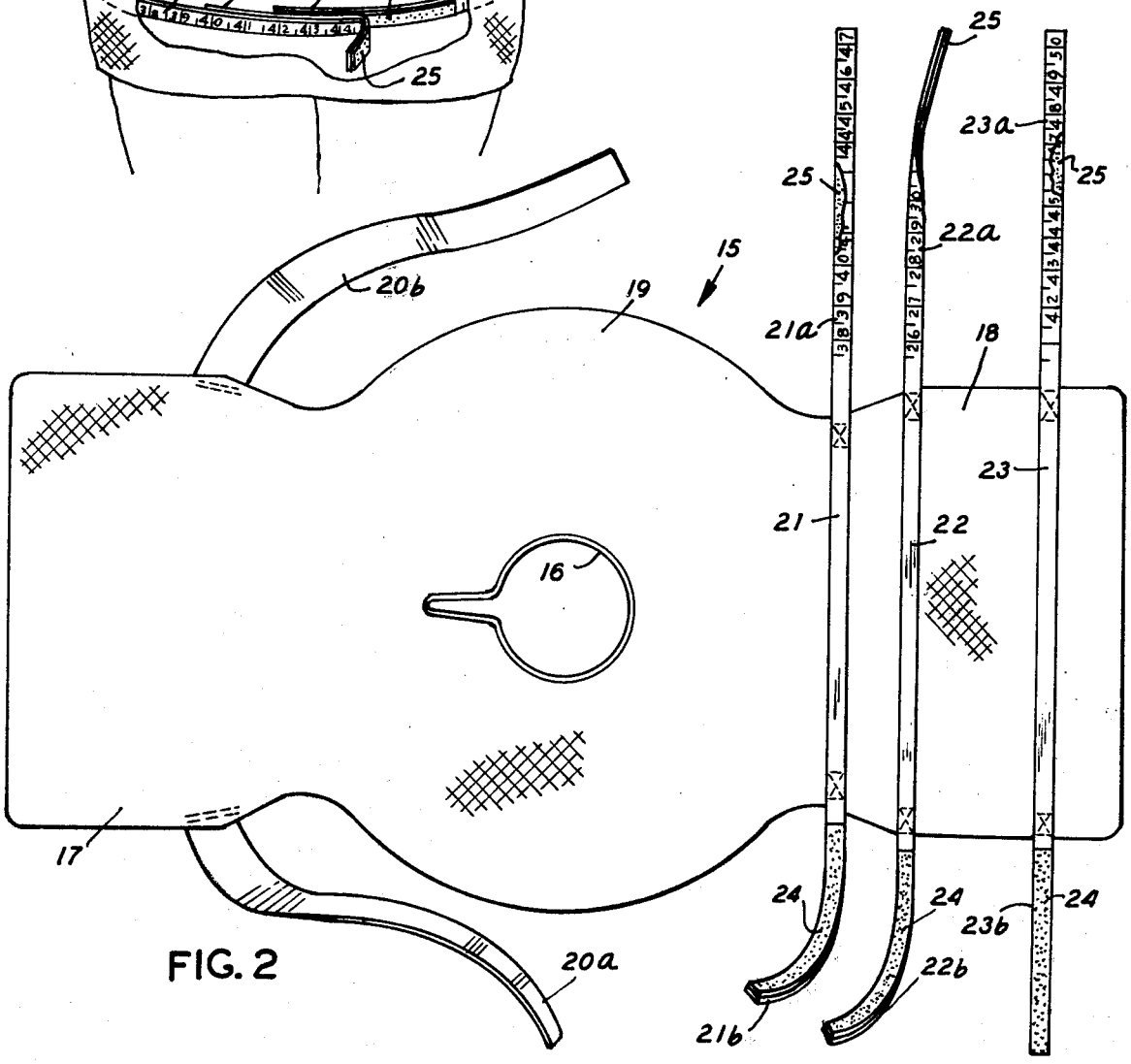
FIG. 2 is a top plan view of the garment per se as laid out flat.

The garment illustrated in FIGS. 1 and 2 constitutes an upper garment 15, such as a woman's overblouse, apron or the like. This garment is made in the form of a poncho-type overblouse with a neck opening 16 and a front panel 17 and a rear panel 18. The garment is widened slightly on both sides of the neck opening to form simulated half sleeve elements 19 and a pair of sash elements **20*a* and 20*b* are provided on the respective side edges of the front panel 17**.

The back panel has three measuring tapes or strips 21, 22 and 23 securely attached thereto, each having at least one calibrated end portion respectively designated by the reference characters **21*a*, 22*a* and 23*a*. The other end portions of said tapes are respectively designated by the reference characters 21*b*, 22*b* and 23*b* and in the form shown are adapted to underlie the above identified calibrated end portions. Suitable means for attaching the two end portions of each tape are provided, such as the mating velcro surfaces 24 and 25, respectively provided on the lapping end portions of the tapes illustrated. Velcro is the trademark for a suitable connecting system made by the Hartwell Corp., Los Angeles, Calif. To put on the garment, the head is merely inserted through the opening 16 and the tapes 21, 22 and 23 are wrapped around the body to attach the back panel 18 to the body, with the front panel 17 thrown back over the wearer's shoulder to facilitate wrapping the tapes and viewing the calibrated measurement. The front panel is then dropped into place and the sash elements 20*a* and 20*b*** are tied together at the back.

Figure 3:
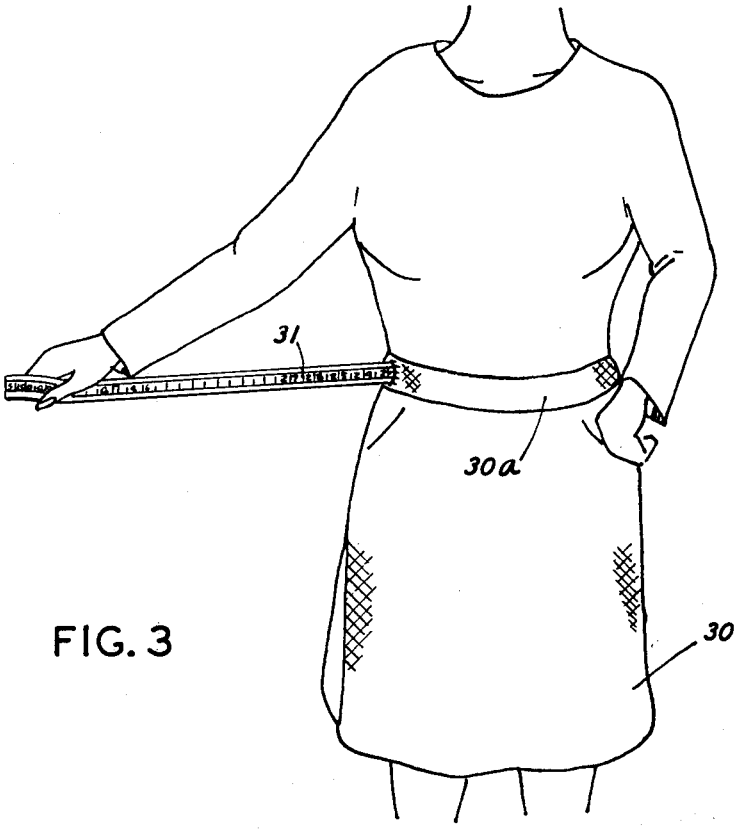
FIG. 3 is a front perspective view of an alternative form of garment.
Figure 4:
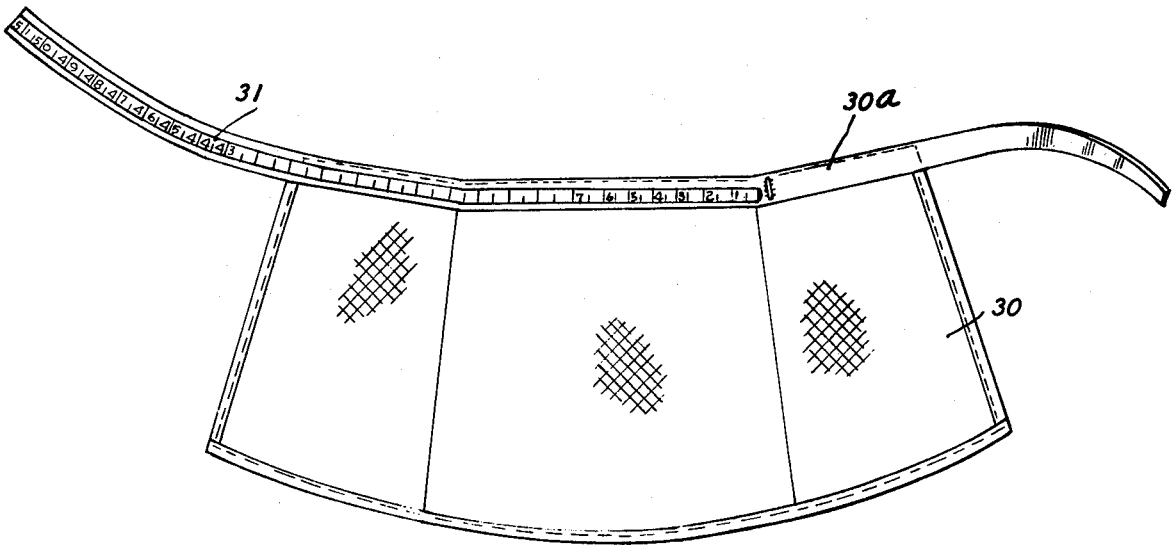

An alternative form of garment embodying the invention is shown in FIGS. 3 and 4 which constitutes a wraparound or dirndl type skirt 30 which has a calibrated tape 31 connected on the inside of the belt and waist band **30*a* of the skirt. The tape 31 is sewn to the inside of the waist band and attaching belt 30*a*** so that when said belt is wrapped around the wearer the measurement will be indicated by the calibrated number on the tape which is in registration with the underlying end of the tape on the inside of the waist band. This will indicate the waist measurement to the wearer whenever the garment is put on.

It will be seen that I have provided a relatively simple, yet effective, way of providing a measurement indicator for critical circumferential body areas in combination with a garment which is frequently worn so as to frequently indicate to the wearer the desired measurements on a day-to-day basis.

It will of course be understood that various changes may be made in the form, details, arrangement and proportions of the parts without departing from the scope of this invention, which generally stated, is as set forth in the appended claims.

What is claimed is:

1. A garment assembly specifically constructed for regular use by a wearer and indicating to only the wearer the wearer's measurements whenever the garment is put on, the garment assembly comprising, a garment for surrounding a portion of the wearer's body, at least one elongated body surrounding measuring strip, having portions thereof attached to an interior surface of said garment at the elevation of the circumferential portion of the body to be measured, said strip including at least one normally free end portion with connecting means for connection to the other end in overlapping body surrounding relation, said free end portion being calibrated with measuring indicia on a surface not exposed to others to automatically indicate the circumferential measurement of the selected body portion whenever the garment is put on.

2. The structure set forth in claim 1 wherein the two overlapping end portions of the strip elements are connectable at any location to produce accurate measurement.

3. The structure set forth in claim 2 wherein attachment means comprises a velcro tape connecting means respectively provided on the overlapping mating end portions of said strips.

4. The structure set forth in claim 1 wherein three elongated measuring strips are attached to said garment to respectively measure the bust line, waist line and hips of the wearer with each strip including said free end connecting means and said measuring indicia.

5. The structure set forth in claim 4 wherein said garment comprises a poncho type overblouse having a back panel with the measuring strips attached thereto and a front panel with sash means for tying the front panel around in overlapped relation to the side portions of said back panel.

6. The structure set forth in claim 1 wherein said garment constitutes a dirndl wraparound type skirt having a wraparound waist band with said measuring strip attached on the inside of the waist band thereof.

* * * * *